United States Patent [19]

Vine

[11] 4,173,727

[45] Nov. 6, 1979

[54] ELECTRON IMAGE DEVICE

[75] Inventor: James Vine, Elmira, N.Y.

[73] Assignee: Westinghouse Electric Corp., Pittsburgh, Pa.

[21] Appl. No.: 560,385

[22] Filed: Jun. 23, 1966

[51] Int. Cl.[2] ..... H01J 39/00

[52] U.S. Cl. ..... 313/99; 313/102; 250/213 VT

[58] Field of Search ..... 313/65, 94, 64, 99, 313/102; 250/213 VT

[56] References Cited

U.S. PATENT DOCUMENTS

| | | | |
|---|---|---|---|
| 2,692,341 | 10/1954 | Schagen et al. | 313/65 X |
| 2,757,293 | 7/1956 | Teves et al. | 313/65 X |
| 2,994,798 | 8/1961 | Krieger et al. | 250/213 VT |
| 3,225,204 | 12/1965 | Schagen et al. | 313/65 X |
| 3,280,356 | 10/1966 | Stoudenheimer et al. | 313/102 |

*Primary Examiner*—Theodore M. Blum
*Attorney, Agent, or Firm*—W. G. Sutcliff

[57] ABSTRACT

This invention relates to electron image devices for focusing an electron image derived from a photocathode element onto a target element with a substantially planar surface. More specifically, the photocathode element has an electron emitting surface of a substantially spherical configuration, a cylindrical electrode disposed around the axis of this device and having a diameter of a magnitude in the approximate range of 2.0 to 2.2 times the length of the radius of the photocathode element, an anode element having an aperture therein with a diameter of a magnitude not less than 0.3 nor more than 0.5 times the length of the photocathode radius, and a conical portion extending from the aperture at an angle of approximately 45° with respect to the axis of this device.

5 Claims, 2 Drawing Figures

ELECTRON IMAGE DEVICE

Figure 1:
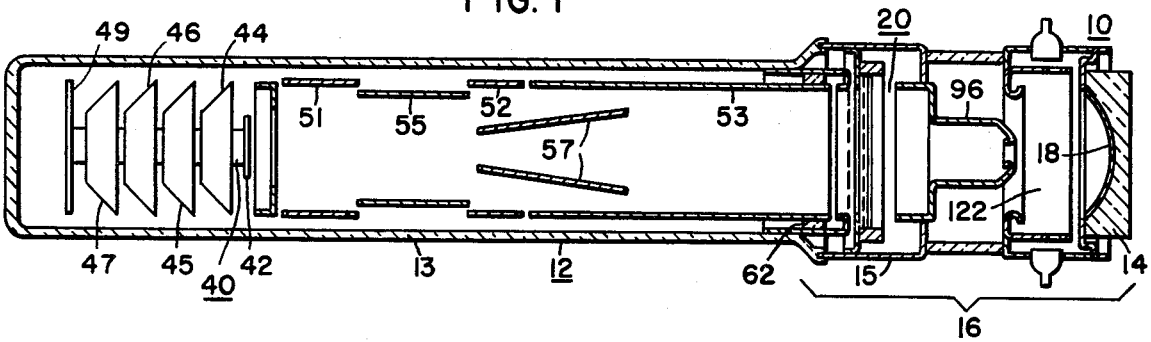

This invention relates to electron image devices for converting radiation images into electron images corresponding thereto and more particularly to the configuration and the spacing of the elements of such a device.

Typically, an electron image device of the type described above includes a photocathode element responsive to incident radiation for establishing an electron image corresponding to the incident radiation image and an electron optical system for focusing the electron image onto a prescribed target surface. The electron-optical system which may illustratively include an anode element and a cylindrical focusing electrode disposed between the photocathode element and the anode element. Typically, the anode has an aperture of small diameter (in comparison with the dimensions of the photocathode element) through which the electron image is accelerated. In one form, the target surface may be a fluorescent layer serving as a viewing screen. In an alternative form, an embodiment of which will be described in detail later, the prescribed surface may be a storage member upon which there is established a pattern of charges corresponding to the electron image. Such an electron discharge device could be used as a television camera device wherein a beam of electrons would be directed upon the storage member to thereby derive an output signal corresponding to the electron and radiation images.

In electron image devices wherein the electron image is focused onto a fluorescent layer, the contour of the viewing screen is constructed to match the shape of the focal surface of the electron image and thereby improve the resolution uniformity of the electron image. However, this solution is not practicable when it is necessary to focus the electron image onto the flat surface of a storage target member of a television camera tube. In such instances where it is difficult if not impossible to provide a curved target surface, it is desirable to provide an electron-optical system having a flat focal plane. In an existing high resolution electron image device with an electron-optical system including a curved cathode element and an anode element of a conical configuration, the electron image is focused upon a flat target with a resolution at its central portion of greater than 100 line pair per millimeter for a typical anode potential of about 10 KV. However, due to the curvature of the focal surface, the resolution at the edges of the field may be only about 20 line pair per millimeter.

It is therefore an object of this invention to provide a new and improved electron image device which avoids the above-described difficulties of the prior art.

It is an important object of this invention to provide a new and improved electron image device having an electron optical focusing system capable of improved resolution over the entire target surface.

It is another object of this invention to provide a new and improved electron image device having therein an electron-optical system capable of converting a radiation image into an electron image and focusing the electron image onto a flat surface with great resolution.

A particular object of this invention is to provide an improved electron image device having an electron-optical system with an image surface which is flatter than that obtained by electron-optical systems of the prior art.

A still further object of this invention is to provide an electron image device with an improved electron-optical system capable of converting a radiation image into an electron image and focusing the electron image onto a storage target member with a flat surface.

Briefly, the objects of this invention are accomplished by providing an electron image device having an electron-optical system including a photocathode element capable of converting a radiation image into an electron image, a cylindrical focusing electrode disposed about the electron image and having a shielding extension extending radially toward the axis of the electron-optical system, and an anode element with a tapered or conical portion with an aperture therein of such size to focus the electron image with great resolution onto a substantially flat target surface. More particularly, the photocathode element has a spherical configuration of a radius R and the aperture of the anode element has a diameter of approximately 0.3 to 0.5 R in order to provide the desired flat focal surface of the electron-optical system.

Further, in accordance with the teachings of this invention, it has been discovered that an anode opening of approximately 0.4 R provides an optimum flat focal surface. In addition, the diameter of the focusing electrode should be chosen to be in the approximate range of 2 R to 2.2 R and the shielding extension should be disposed from the photocathode element a distance not less than 1.5 R nor in excess of 2 R.

It is noted in one specific embodiment of this invention, that the electron-optical system as described above could be incorporated into a television camera tube which would include a storage target having a substantially flat surface onto which the electron image would be focused.

Figure 2:
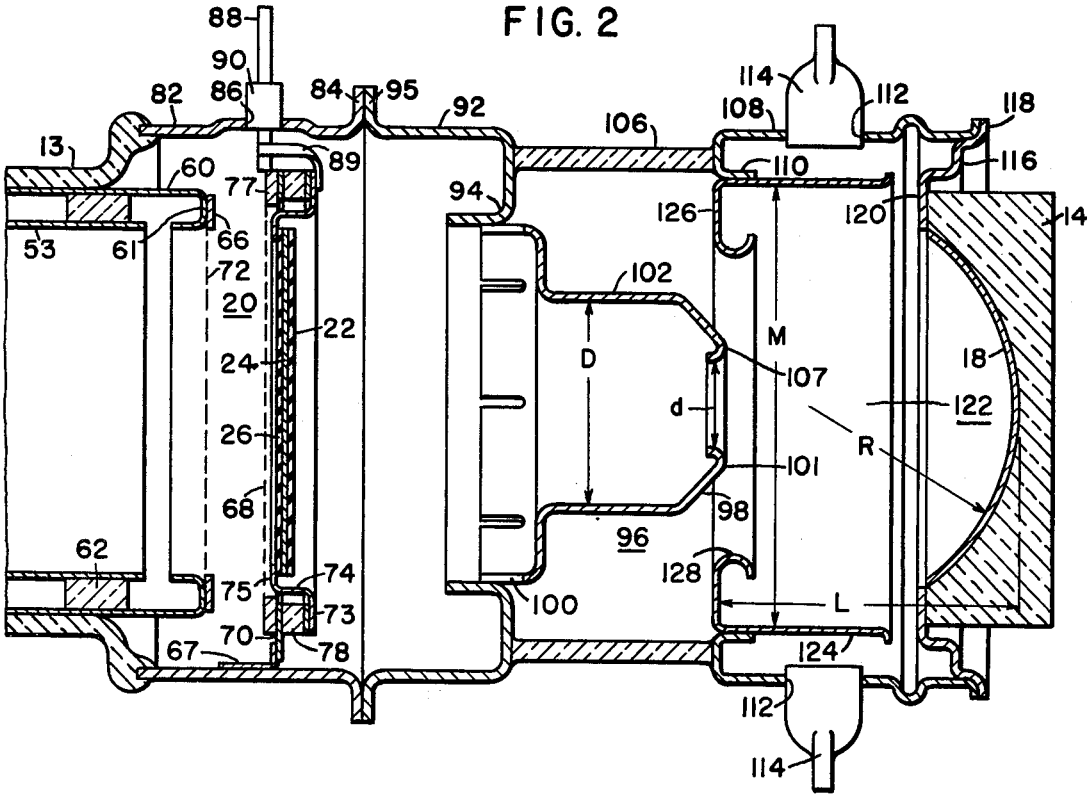

These and other objects and advantages of the present invention will become more apparent when considered in view of the following detailed description and drawings, in which:

FIG. 1 is a sectioned view of a television camera tube embodying the present invention; and FIG. 2 is a sectional view in greater detail of the image section of the device of FIG. 1.

Referring now to the drawings and in particular to FIG. 1, there is illustrated a television camera device 10 incorporating the teachings of this invention. The television camera device 10 includes an envelope 12 having at one end, a narrowed portion 13 at one end, and an enlarged portion 15 at the other. The enlarged portion 15 is enclosed at one end by a face plate 14 made of a suitable radiation transmissive material such a quartz or an array of fiber optics. Illustratively, the inner surface of the face plate 14 is of a concave configuration upon where there is disposed a photocathode element 18 capable of converting a radiation image into a corresponding electron image.

A focusing electrode 122 and an anode element 96 are spaced from the photocathode element 18 for focusing the electron image onto the substantially flat surface of a target member 20. The target member 20 establishes, in response to the bombardment of the electron image, a corresponding pattern of charges. Upon the opposite side of the target 20, there is disposed an electron gun 40 for generating and scanning a pencil beam of electrons onto the target member 20 to derive an electrical output signal corresponding to the pattern of charges stored thereon. More specifically, there are provided a series of accelerating electrodes 51, 52 and 53 of a cylindrical configuration disposed about the axis of the envelope 12. Further, a focusing electrode 55 is disposed between the accelerating electrodes 51 and 52, and a set of deflection electrodes 57 is disposed so as to deflect the pencil beam electrons over the surface of the target member 20 in a defined pattern or raster. In the particular embodiment illustrated in FIG. 1, the output signal is derived by a return beam of electrons which is modulated by the pattern of charges established upon the target member 20 and which is collected by a dynode structure consisting of a first dynode 42 and a plurality of dynode elements 44 to 47 which are mounted about the electron gun 40. The return beam of electrons is directed as by the focusing electrodes onto the first dynode 42 to be successively multiplied by the dynode elements 44 to 47 and finally collected by a dynode-anode 49 to thereby provide an output signal corresponding to the input radiation image.

Referring now to FIG. 2, there is shown in more detail the structure of the target member 20. More specifically, the target member 20 in an illustrative embodiment includes a support layer 22 of a suitable insulating material such as aluminum oxide. A layer 24 of a suitable electrically conductive material such as aluminum is disposed upon the support layer 22 and a layer 26 of a storage dielectric material is disposed upon the electrically conductive layer 24. Illustratively, the layer 26 of porous dielectric storage material may be of a suitable material such as potassium chloride and may be deposited in a porous form having a density of less than 10% of that of its bulk density. A target member with such a porous storage layer is an extremely sensitive target member and is more fully described with respect to its structure and operation in U.S. Pat. No. 3,213,316 to Geotze et al and assigned to the assignee of this invention.

Further, the target member 20 is mounted upon an S-shaped support member 74. More specifically, the support member 74 has a radially extending flange portion 75 upon which the peripheral edge of the layer 26 is secured, and an outwardly extending flange portion 73 which is supported upon and secured to an insulating ring 78. The insulating ring 78 is mounted upon an annular support member 70, which is in turn secured to the inwardly extending portion of a support flange 67. Further, a first screen mesh 68 is supported in a spaced, parallel relationship with the surface of the layer 26 of the target member 20 by a screen support ring 77; the support ring 77 is in turn secured to and supported upon the member 70.

The support flange 67 is secured to and mounted upon the inner periphery of a first metallic cylinder 82 which forms a part of the envelope 12. As shown in FIG. 2, an end portion of the cylinder 82 is sealed to the narrow portion 13 of envelope 12. A second screen or mesh 72 is spaced from and disposed parallel to the surface of the layer 26 of storage dielectric material. The second screen 72 is supported upon a screen support ring 66 which is in turn mounted upon a cylindrically shaped support member 60 having a cup-shaped flange portion 61. More specifically, the screen 72 and the ring 66 are mounted upon and secured to the cup-shaped flange portion 61. The accelerating electrode 53 is spaced from and insulated from the cylindrical support member 60 by an insulating ring 62 disposed therebetween.

Electrical contact may be made to the target member 20 as by a connector terminal 88 which is inserted through an aperture 86 within the first metallic cylinder 82. More specifically, an insulating bushing 90 of a suitable insulating material such as glass or aluminum oxide serves to support and insulate the terminal 88 with respect to the first metallic cylinder 82. A strip 89 of electrically conductive material may be secured to the terminal 88 and to the support member 74 as by spot welding to make an electrical connection therebetween.

The enlarged portion 15 of the envelope 12 is further formed by a second metallic cylinder 92. The second metallic cylinder 92 has a flange portion 95 which is secured to a flange portion 84 associated with the first metallic cylinder 82 as by heli-arc welding to thereby form a vacuum tight seal. Further, the second metallic cylinder 92 has upon its other end a cup-shaped support portion 94 which extends inward toward the axis of the envelope 12. The anode element 96 is mounted upon the support portion 94 and may be secured thereto as by spot welding. The anode element 96 has a flange portion 100 which fits within and is secured to the opening formed by the cup-shaped portion 94. Further, the anode element 96 has a conical portion 98 which slopes inwardly at an angle of approximately 45° with respect to the axis. The end of the conical portion 98 is formed into a lip 107 to provide an aperture 101 through which the electron image is directed. A cylindrical section 102 is disposed between and interconnects the conical portion 98 with the flange portion 100 of the anode element 96.

The enlarged portion 15 of the envelope 12 also includes an intermediate section 106 made of a suitable insulating material such as glass which is bonded to the support portion 94 of the second metallic cylinder 92 at one end and is bonded to a third metallic cylinder 108 at its other end. Further, the third metallic cylinder 108 has a cup-shaped flange portion 110 upon which the focusing electrode 122 is supported. A plurality of tubulations 114 are disposed through apertures 112 within the third metallic cylinder 108. In the processing of the television camera device 10, the envelope 12 is evacuated through the tubulations 114 which are then sealed by crimping. The face plate 14 is supported as upon an annular support member 116. The support member 116 has an inwardly extending flange 120 which is secured to the face plate 14, and also a crimped portion 118 which may be sealed as by heli-arc welding to the end of the third metallic cylinder 108. The focusing electrode 122 has a cylindrical portion 124 and an inwardly extending flange or shielding portion 126. Further, the end of the shielding portion 126 is formed into a lip portion 128 which defines an aperture concentric with the axis of the envelope 12.

In accordance with the teachings of this invention, the configuration of and the spacing between the elements have been so modified to provide an optical system with a substantially flat focal surface. A focal surface may be defined as that surface in which the electron image is focused. More specifically, the photocathode element 18 is of a spherical configuration as defined by a radius R having its center of curvature upon the axis of the envelope 12. One of the prime aspects of this invention is that the anode aperture 101 is significantly larger than is customarily employed in electron image devices with curved photocathode elements. More specifically, it has been found that a substantially flat focal surface may be optimumly provided where the diameter d of the aperture 101 is constructed to be 0.4 times the radius R of the photocathode element 18. However, it has also been found that the diameter d of the aperture 101 may vary in the approximate range of 0.3 to 0.5 times the radius R of the photocathode element with satisfactory results. This increase in size of the aperture 101 provides a smoother transition between the spherical potential field existing in the region of the photocathode element 18, and the negative lens effect established at the aperture 101. By making the aperture 101 too large, the strength of the focusing field at the photocathode element 18 would be too weak with consequent loss of resolution. Further, the anode element 96 has the conical portion 98 which recedes from the opening 101 at an angle of approximately 45° with respect to the axis of the envelope 12. The diameter of the anode element 96 expands to that of the cylindrical portion 102 (i.e. dimension D) which is approximately equal to or greater than twice the diameter d of the aperture 101. This allows a clear passage of the electron image directed through the anode element 96 to the target member 20 and also aids to a certain degree in shaping the focusing field.

Further, it has been discovered that the shape and also the position of the focusing electrode 122 does contribute to focusing of the electron image emitted from the photocathode element 18 onto the flat surface of the target member 20. More specifically, the focusing electrode 122 has a cylindrical portion 124 of a diameter M which is constructed to be of a magnitude not less than two times the radius R of the photocathode element 18 nor greater than 2.2 times the radius R of the photocathode element. Further, the flange or shielding portion 126 is disposed from the photocathode element 18 as measured axially from the center of the photocathode element 18 a distance L which is determined to be of a magnitude not greater than 1.5 times the radius R nor less than one times the radius R of the photocathode element 18. Thus, the electron-optical system is capable of focusing an electron image in a substantially flat focal surface and the focal of this system may be made coincident with the surface of the target member 20. More specifically, for a field of about one inch and a potential of approximately 10,000 volts established between the photocathode element and the anode element, a resolution in excess of 80 line pair per millimeter has been observed at all points in the focal surface of this system.

Further, it is noted that the position of the photocathode element may be varied with respect to the anode element to achieve any desired magnification in the approximate range 0.4 to 1.5 while maintaining a substantially flat focal surface.

Since numerous changes may be made in the above described apparatus and different embodiments of the invention may be made without departing from the spirit thereof, it is intended that all matter contained in the foregoing description or shown in the accompanying drawings, shall be interpreted as illustrative and not in a limiting sense.

I claim as my invention:

1. An electron-optical system comprising a photocathode element for emitting an electron image in response to a radiation image directed thereon, said photocathode element including an emitting surface of substantially spherical configuration having a radius with a center of curvature on the axis of said electron-optical system, and an anode disposed about the axis of said electron-optical system, said anode having an aperture through which said electron image is directed, said aperture having a diameter of a magnitude not less than 0.3 nor more than 0.5 times the length of said radius, said anode has a conical portion extending away from said aperture at an angle of approximately 45° with respect to the axis of electron-optical system, and a focusing electrode is disposed between said photocathode element and said anode element, said focusing electrode has a cylindrical portion disposed coaxially about the axis of said electron-optical system, said cylindrical portion having a diameter of a magnitude in the approximate range of 2.0 to 2.2 times the length of said radius.

2. An electron-optical system as claimed in claim 1, wherein the magnitude of said diameter if optimumly 0.4 times the length of said radius.

3. An electron-optical system as claimed in claim 1, wherein said anode has a cylindrical portion extending from said conical portion, said cylindrical portion disposed coaxially about the axis of said electron-optical system and having a diameter not less than 2.0 times the diameter of said aperture.

4. An electron-optical system as claimed in claim 1, wherein said focusing electrode has a cylindrical portion disposed coaxially about the axis of said electron-optical system, and a shielding portion extending therefrom toward the axis of said electron-optical system, said shielding portion disposed from said photocathode element as measured along the axis of said electron-optical system a distance not less than 1 nor more than 1.5 times the length of said radius.

5. An electron-optical system as claimed in claim 1, wherein said focusing electrode has a cylindrical portion disposed coaxially about the axis of said electron-optical system, said cylindrical portion having a diameter of not less than 2 times nor greater than 2.2 times the length of said radius, said focusing electrode further having a shielding portion extending from said cylindrical portion toward the axis of said electron-optical system, said shielding portion disposed from said photocathode element a distance as measured along the axis of said electron-optical system of not less than 1 nor greater than 1.5 times the length of said radius.

* * * * *